US009499372B1

(12) United States Patent
Shield

(10) Patent No.: US 9,499,372 B1
(45) Date of Patent: Nov. 22, 2016

(54) SYSTEM AND APPARATUS FOR STORAGE, TRANSPORT AND MANAGEMENT OF ELECTRICAL CORD AND CABLE

(71) Applicant: Brian W. Shield, Indianapolis, IN (US)

(72) Inventor: Brian W. Shield, Indianapolis, IN (US)

( * ) Notice: Subject to any disclaimer, the term of this patent is extended or adjusted under 35 U.S.C. 154(b) by 0 days.

(21) Appl. No.: 15/073,822

(22) Filed: Mar. 18, 2016

(51) Int. Cl.

| | |
|---|---|
| ***B65D 85/04*** | (2006.01) |
| ***B65H 75/36*** | (2006.01) |
| ***B65D 33/06*** | (2006.01) |
| ***B65D 33/16*** | (2006.01) |
| ***B65D 30/00*** | (2006.01) |
| ***A45C 11/00*** | (2006.01) |

(52) U.S. Cl.
CPC ..... *B65H 75/362* (2013.01); *A45C 11/00* (2013.01); *B65D 29/00* (2013.01); *B65D 33/06* (2013.01); *B65D 33/165* (2013.01)

(58) Field of Classification Search
USPC ..... 206/700, 702, 409
See application file for complete search history.

(56) References Cited

U.S. PATENT DOCUMENTS

| | | | | |
|---|---|---|---|---|
| 5,439,109 | A * | 8/1995 | McBride | A45C 7/0077 174/135 |
| 6,267,244 | B1 * | 7/2001 | Witt | H02G 11/02 206/702 |
| 8,028,834 | B2 * | 10/2011 | Lill | A61M 16/0875 206/438 |
| 8,123,027 | B2 * | 2/2012 | Kirkham | A45C 3/00 102/324 |
| 8,960,431 | B2 * | 2/2015 | Copp | B65D 85/04 206/395 |
| 2004/0188318 | A1 * | 9/2004 | Fellows | H02G 11/02 206/702 |
| 2011/0203958 | A1 * | 8/2011 | Imburgia | B65H 75/362 206/388 |
| 2015/0101958 | A1 * | 4/2015 | Cross | A45C 5/14 206/702 |

* cited by examiner

*Primary Examiner* — Jacob K Ackun
(74) *Attorney, Agent, or Firm* — C. John Brannon; Brannon Sowers & Cracraft PC

(57) ABSTRACT

An apparatus the storage of electrical cord, including an elongated bag defining an exterior surface and an interior storage volume with a circular opening at one end, a cord channel around the opening, a closure cord extending through the channel, a cord lock connected to the closure cord, a slot formed through the exterior surface, an elongated apron positioned to cover the slot and connected to the exterior surface, defines opposing side apertures for communication with the slot, a pocket formed on the apron, at least one transverse strap extending across the apron for securing cord extended between the strap and the apron, and a carry strap with the first end connected to the bag and the second end connected to the bag opposite the apron. A male end of a length of electrical cord may be fed into the bag through the slot and out a respective side aperture. The remaining length of electrical cord may be fed into the bag for storage.

7 Claims, 6 Drawing Sheets

SYSTEM AND APPARATUS FOR STORAGE, TRANSPORT AND MANAGEMENT OF ELECTRICAL CORD AND CABLE

TECHNICAL FIELD

The present novel technology relates generally to the field of storage containers and, more specifically, to a method and apparatus for storing, transporting, and deploying electrical cords and cable.

BACKGROUND

Electrical extension cords and cables are ubiquitous, with nearly every business and homeowner in possession of at least one, and typically several. While versatile and tremendously useful, electrical cords have a tendency to become tangled when stored. Attempts have been made to address this problem with storage vessels having carabiner-like guides for connected at opposite openings for guiding cord in and out of the vessel. However, this system can be overly complicated for some users and also suffers from the drawback of having multiple moving parts that add to expense of manufacture and repair, and not necessarily operable by all users. Thus, there remains a need for a storage system that allows for the quick and uncomplicated storage of cord between uses, ease of transport, and rapid and efficient deployment of cord when desired, and accommodate a wider range of users. The novel technology addresses these needs.

DETAILED DESCRIPTION

Figure 1:
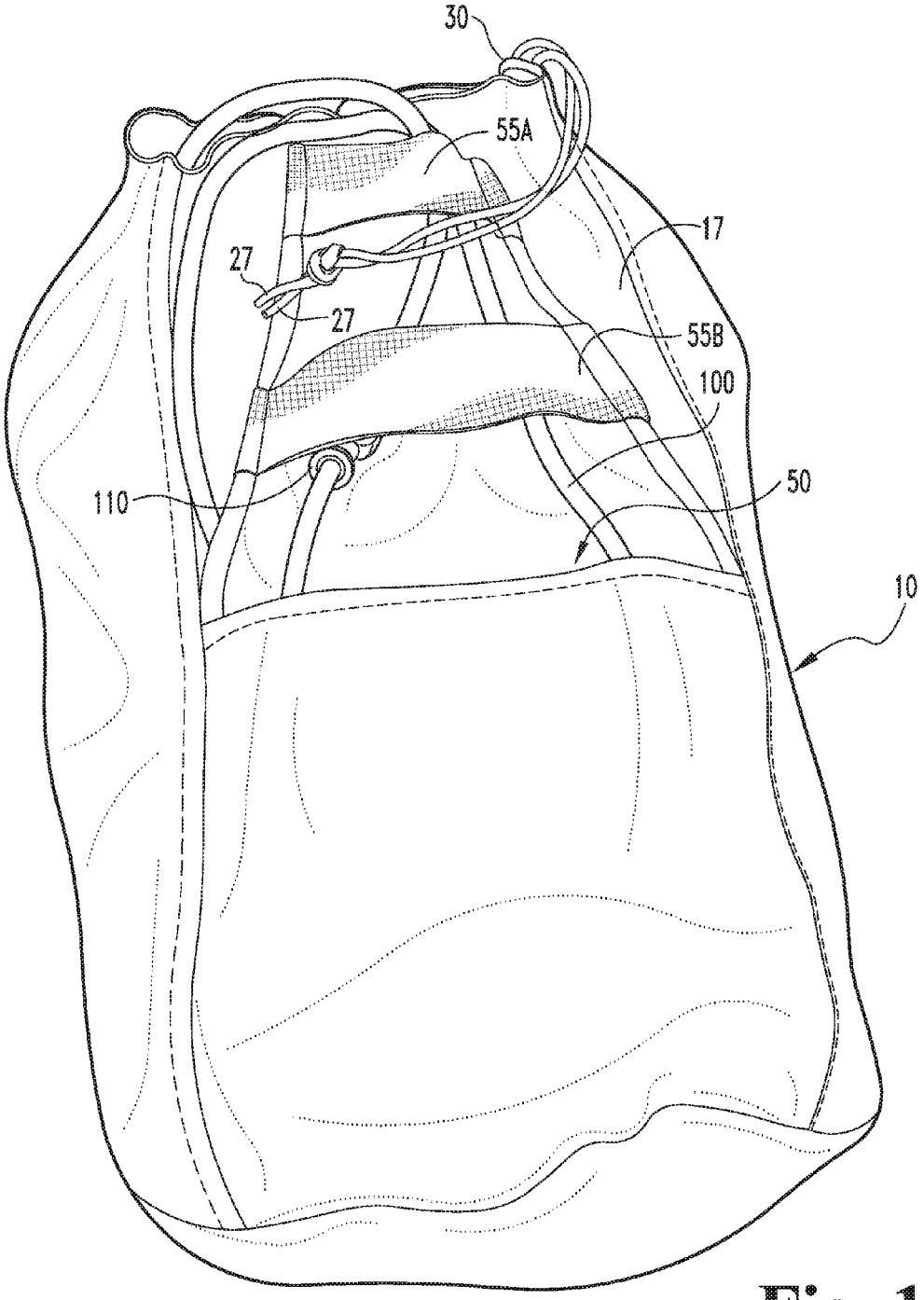
FIG. 1 is a first front perspective view of an electrical cord storage bag system according to a first embodiment of the present novel technology.

For the purposes of promoting an understanding of the principles of the novel technology, reference will now be made to the embodiments illustrated in the drawings and specific language will be used to describe the same. It will nevertheless be understood that no limitation of the scope of the novel technology is thereby intended, such alterations and further modifications in the illustrated device, and such further applications of the principles of the novel technology as illustrated therein being contemplated as would normally occur to one skilled in the art to which the novel technology relates.

Figure 2:
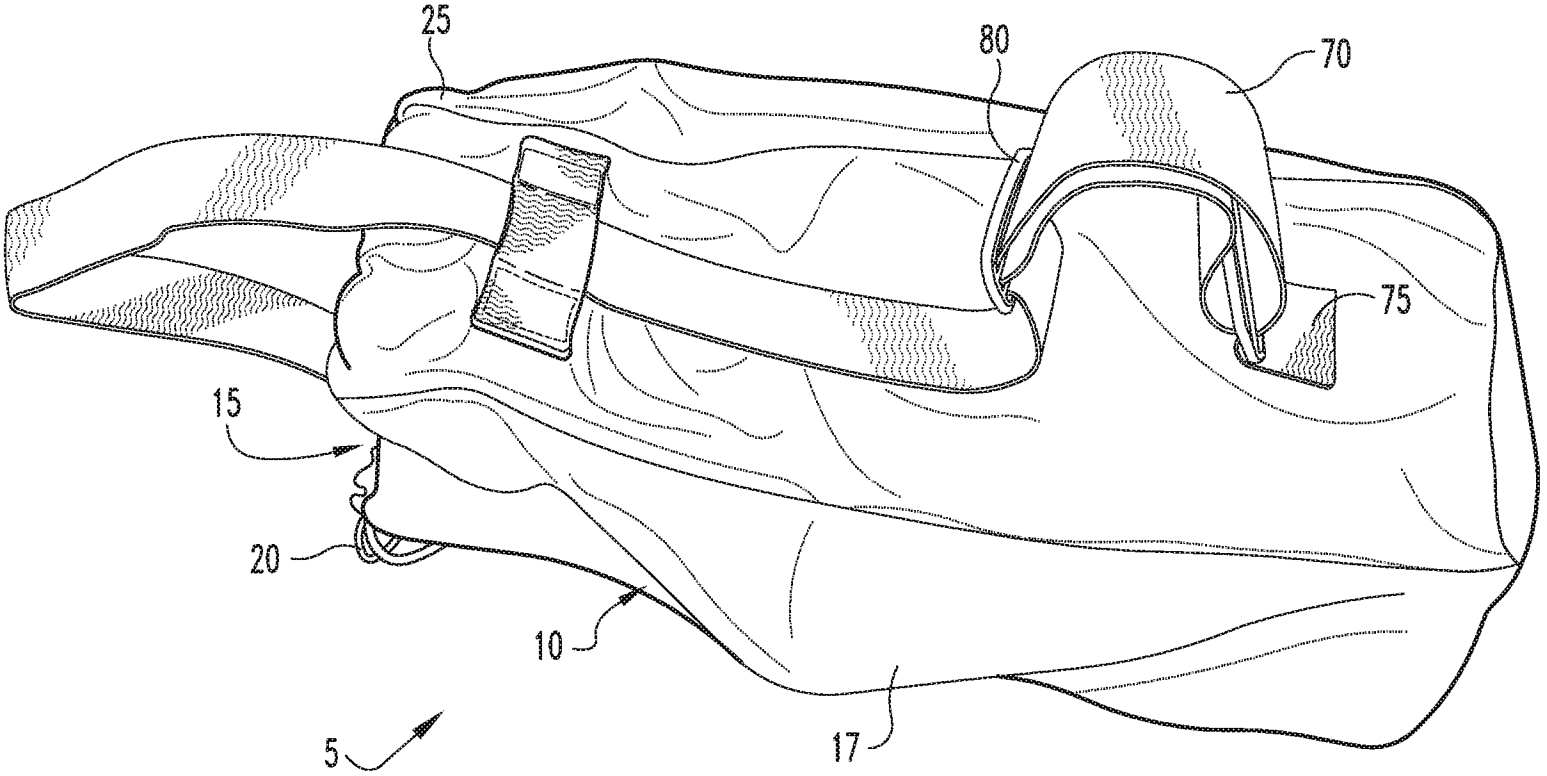
FIG. 2 is rear perspective view of the bag of FIG. 1.
Figure 3:
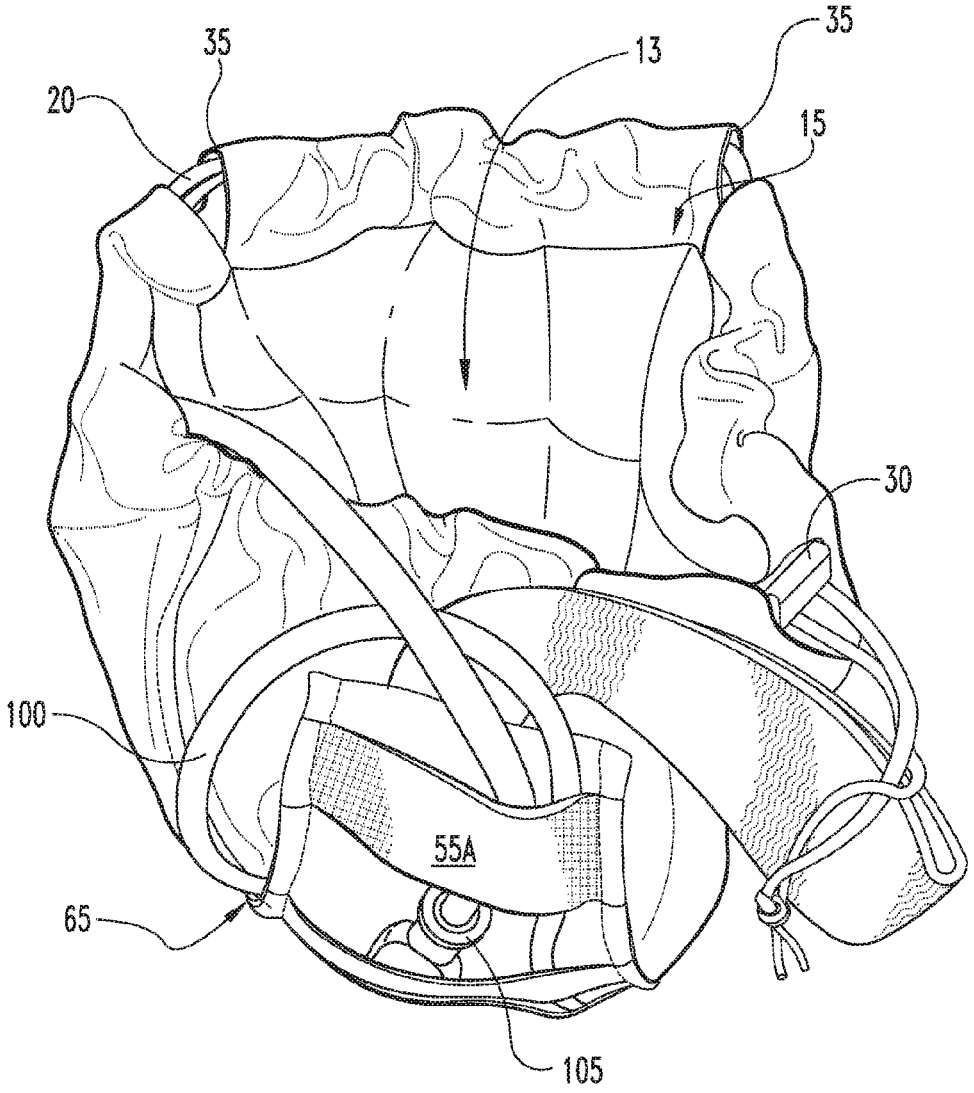
FIG. 3 is a top perspective view of the bag of FIG. 1.
Figure 4:
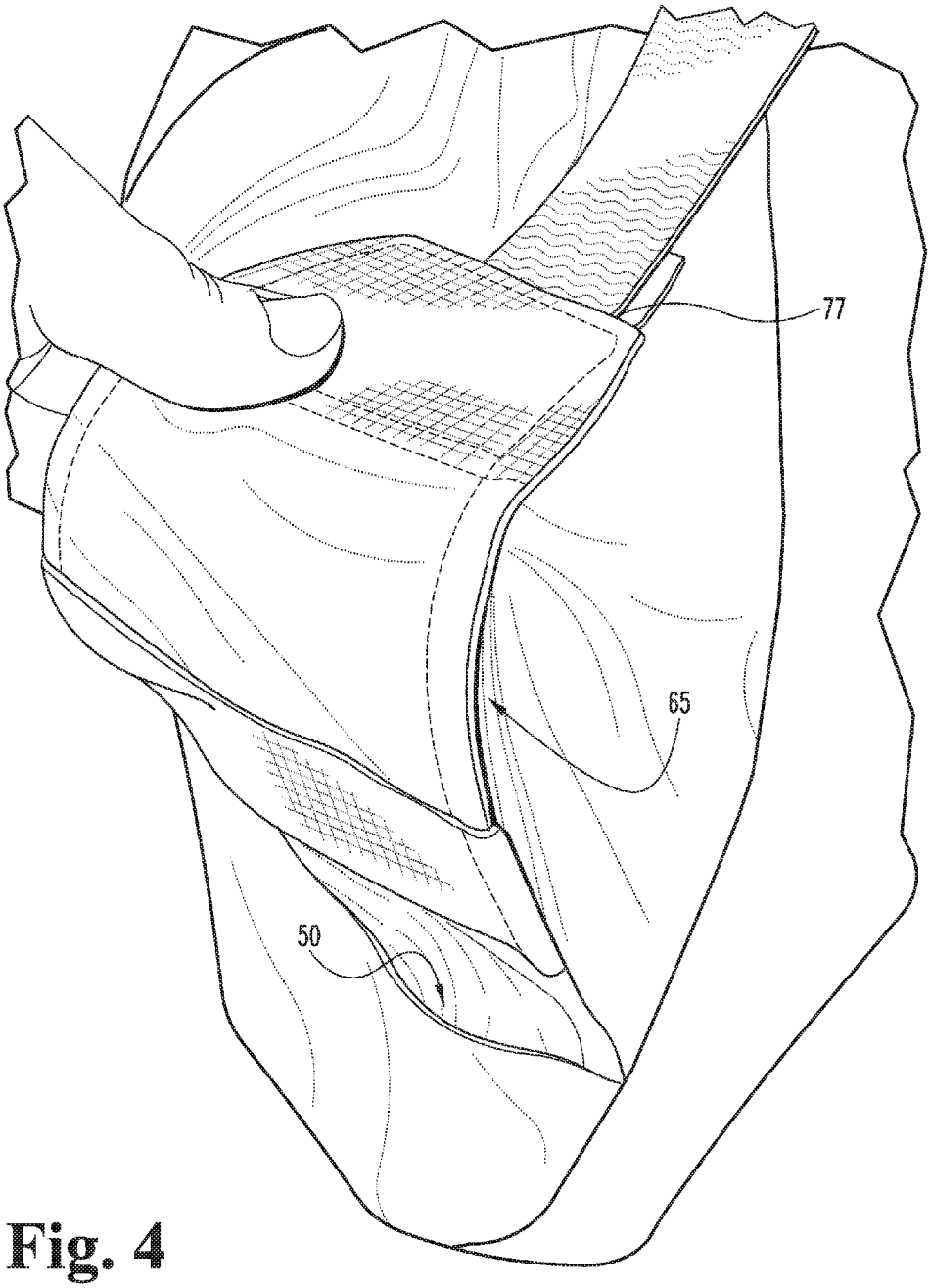
FIG. 4 is an enlarged partial front perspective view of the bag of FIG. 1.
Figure 5:
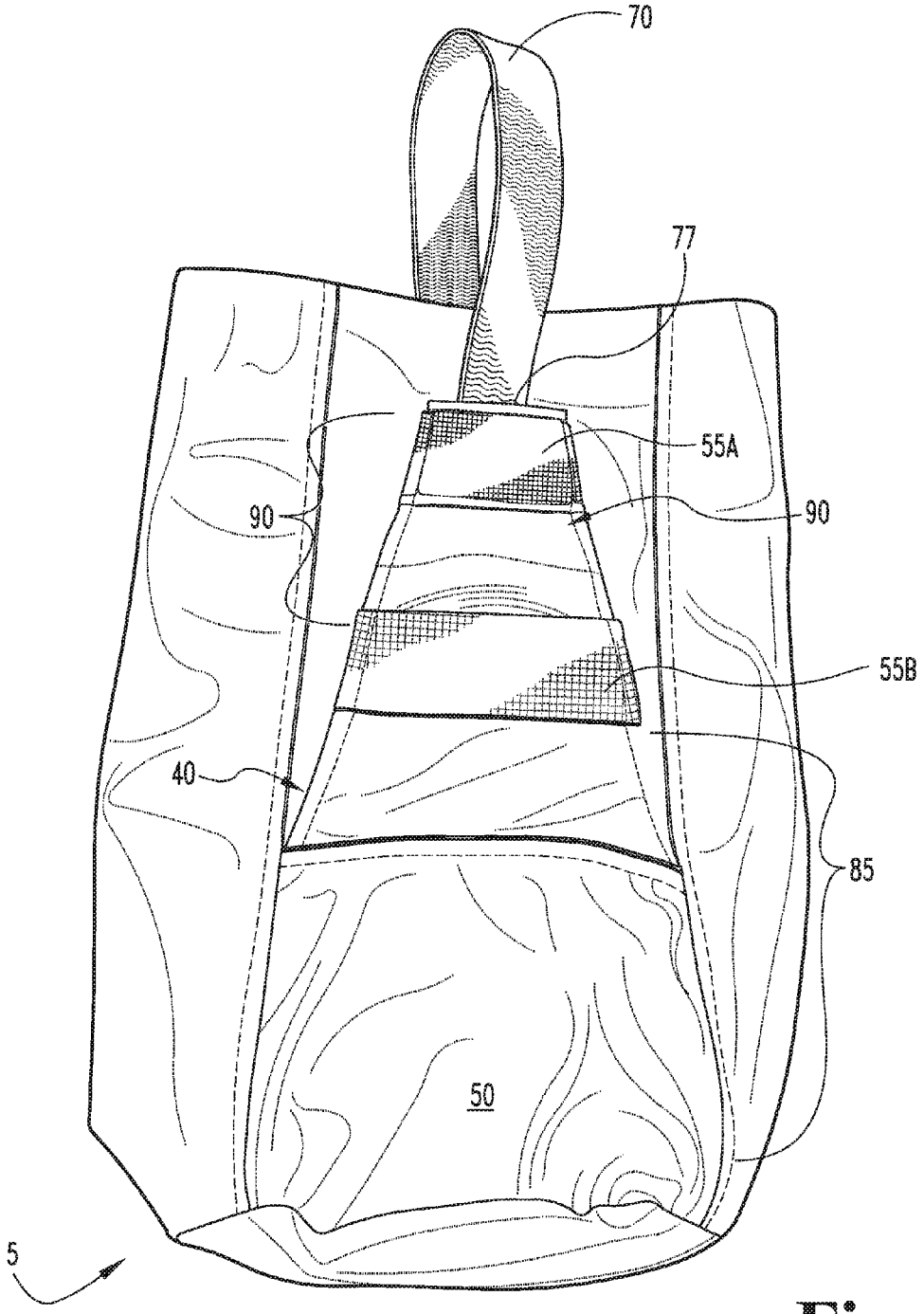
FIG. 5 is a second front perspective view of the bag of FIG. 1.
Figure 6:
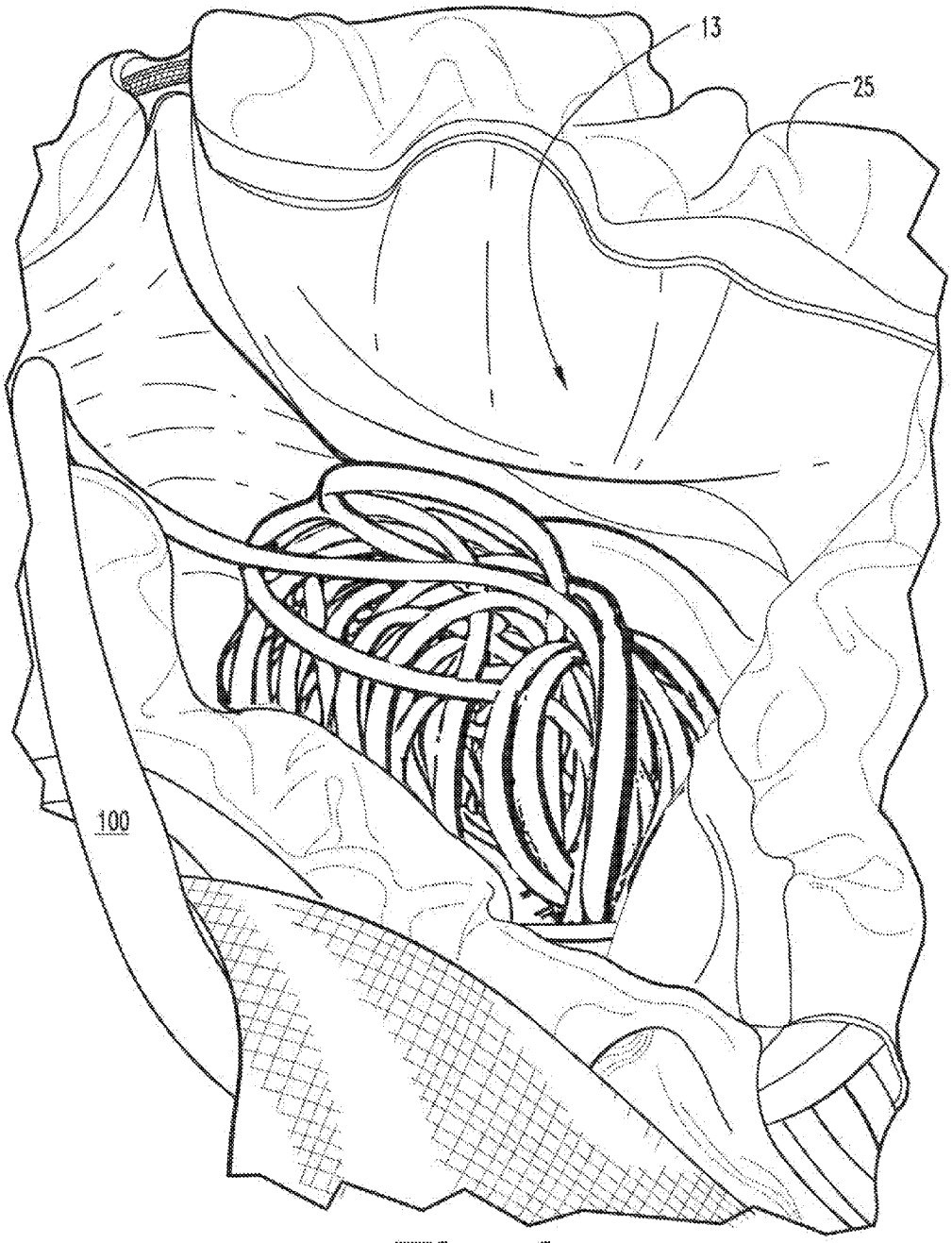
FIG. 6 is a top perspective view of the bag of FIG. 1 as filled with cord.

The present technology relates to a bag for loading, transporting and deploying untangled electrical cord. Electrical cord includes extension cord, strings of ornamental lights, network communications cable, CAT cable, or any electrical cord of any gauge, insulator covering, or conductor count. FIGS. 1-6 illustrate a first embodiment of the novel technology, a system 5 for the sale, collection, transport and dispensing of electrical cord. The system 5 includes am elongated flexible container or bag body portion 10 having a generally circular opening 15 at one end and defining an interior volume 13 disposed opposite a container or bag exterior surface 17. A flexible elongated tie member or cord 20 is operationally connected at or adjacent to the opening 15, typically threaded through a channel 25 with the oppositely disposed ends 27 of the flexible member 20 extending through a sliding cord lock 30. Member 20 and cord lock 30 may be adjusted in channel 25 to exit and mate at one of several openings 35A, B in channel 25.

The system 5 further includes an elongated apron portion 40 connected to the bag 10 and positioned to loosely cover a slot or elongated aperture 45 in the bag 10. The apron further includes an outer pocket 50 and at least one transverse strap 55 extending across the apron 40. The elongated apron 40 is affixed to the bag 10 at opposing ends 60. The opposing sides 65 of the elongated apron 40 are not affixed to the bag 10 and define side apertures 65 through which a cord may communicate, through the underlying slot 45, with the interior of the bag 10.

The system 5 also includes an elongated strap 70 affixed at one end 75 to the bag body 10 adjacent to the neck portion 90 of the apron 40 and/or to the neck portion 90 of the apron 40, and at the other end 77 to the bag body 10, typically at a location on the exterior surface 17 disposed opposite the apron 40. A transverse strap or median loop 43 is typically positioned near the opening or mouth 15 for guiding and allowing free sliding of strap 70 between the loop 43 and the bag body 10. A length adjustment member 80 is operationally connected to the strap 70 for shortening or lengthening the same. A first transverse strap 55A is connected across the central portion 85 of the apron 40, and a second transverse strap 55B is connected across the neck portion 90 of the apron 40 to guide and secure cord. The transverse straps 55A, 55B are connected at either end to the apron 40 and/or the bag body 10, with the bulk of the transverse straps 55A, 55B free to snugly engage cord inserted between the straps 55A, 55B and the apron 40.

In some embodiments, the system 5 includes a length of electrical cord 100 generally disposed within the interior volume 13, typically with ends 105, 110 extending from the interior volume 103. The cord 100 is removably disposed within the bag volume 13.

In operation, one end of a cord 100, typically the male end 105 (but may be either the male end 105 or the opposite female end 110, or neither such as in cords with only one or no terminated ends) is inserted into the interior volume 13 of the bag 10 through mouth 15, directed out of the interior volume through aperture 45 and out one of the side apertures 65. The end 105, 110 is then directed and extended between one or both transverse straps 55A, 55B and the apron 40, and into pocket 50. The remaining cord is then fed into the bag inner volume 13 through the mouth or opening 15, typically one arm length at a time, until the opposite end 110 remains extended just beyond the mouth 15. The opposite end 110 is then directed and extended between one or both transverse straps 55A, 55B and the apron 40, and into pocket 50 or into mating engagement with the other end 105 such that the matingly engaged ends may be positioned in the pocket 50 or looped out of the pocket and held by the straps 55A, 55B.

In use, the ends 105, 110 of the cord 100 may be disengaged from one another and the male end 105 is inserted into a power outlet or other method of termination. The female end 100 is retracted from engagement between the apron 40 and the transverse straps 55A, 55B and a desired length of cord is pulled from the bag 10 and the female end 110 is operationally connected to a device requiring power.

Alternately, the entire extension cord 100 may be completely disengaged and removed from the bag 100.

In use, the carrying strap 70 may be adjusted for ease of carry of the bag as a tote, over the shoulder, or the like. The length adjustment member 80, cord lock 30, median loop 43, opposing side apertures 65, and optional openings 35A,B in channel 25 all cooperate to make the system 5 equally usable for either handedness (right or left) and by those with the effective use of only one arm (such as through arthritis or loss of limb), or user preference.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

I claim:

1. An apparatus for the storage, transport and deployment of electrical cord, comprising:

an elongated bag defining an exterior surface and an interior storage volume and having a generally circular opening at one end;

a channel positioned around the generally circular opening;

an elongated flexible tie member having opposing tie ends and extending through the channel;

a tie member lock operationally connected to the opposing tie ends of the elongated flexible tie member;

an elongated aperture formed through the exterior surface for communication with the interior volume;

an elongated apron having a neck portion positioned adjacent the generally circular opening and a body portion positioned to cover the elongated aperture, wherein the elongated apron is connected to the exterior surface and defines opposing side apertures for communication with the elongated aperture;

a pocket formed on the apron and disposed opposite the exterior surface;

at least one transverse strap extending across the apron for securing electrical cord extended between the at least one transverse strap and the apron; and a carry strap having a first carry strap end and a second carry strap end, wherein the first carry strap end is connected to the bag adjacent the neck portion and the second carry strap end is connected to the bag opposite the apron;

wherein a male end of a length of electrical cord having opposing male and female ends may be fed into the bag, through the elongated aperture and out a respective side aperture; and wherein the remaining length of electrical cord may be fed into the bag for storage.

2. The apparatus of claim 1, wherein both the male and the female ends of the cord may be directed and extended between the at least one transverse strap and the apron and into the pocket.

3. The apparatus of claim 2 further comprising a length of electrical cord disposed in the bag and having opposed male and female ends; and wherein the male and female ends are engaged to one another.

4. The apparatus of claim 1 and further including an elongated flat strap portion connected to the bag and extending across the carry strap adjacent the second carry strap end.

5. A system for the sale, storage, transport and deployment of electrical cable, comprising:

an elongated flexible container defining an exterior surface and an opposing interior storage volume and having a generally circular opening at one end;

a length of electrical cable having opposing first and second ends, where in the electrical cable is generally disposed within the interior volume and wherein the first and second ends extend from the interior volume;

a tie cord channel positioned around the generally circular opening;

a tie cord having opposing ends and generally disposed within the tie cord channel;

a tie cord lock operationally connected to the opposing ends of the tie cord;

an elongated slit formed through the exterior surface for communication with the interior volume;

an elongated apron having a neck portion positioned adjacent the generally circular opening and a body portion positioned to cover the elongated slit, wherein the elongated apron is connected to the exterior surface and defines opposing side apertures for communication with the elongated slit;

a pocket formed on the apron and disposed opposite the exterior surface;

at least one transverse strap extending across the apron for securing cable extended between the at least one transverse strap and the apron; and a carry strap having a first end and a second end, wherein the first end is connected to the bag adjacent the neck portion and the second end is connected to the bag opposite the apron;

wherein the first end of a length of the electrical cable extends through the elongated slit and out a respective side aperture; and wherein the remaining length of electrical cord is removably disposed in the interior storage volume.

6. The system of claim 5 wherein the respective first and second ends are respective male and female ends.

7. The system of claim 5 wherein the length of electrical cable is an extension cord.

* * * * *